US005662019A

United States Patent [19]

Denman

[11] Patent Number: 5,662,019

[45] Date of Patent: Sep. 2, 1997

[54] SAFETY DEVICE FOR WOODWORKING TOOLS

[76] Inventor: Paul M. Denman, 895 Prospect Pl., South Salem, Oreg. 97302

[21] Appl. No.: 433,589

[22] Filed: May 3, 1995

[51] Int. Cl.[6] ..... B27B 25/10

[52] U.S. Cl. ..... 83/425; 83/438; 83/477.2

[58] Field of Search ..... 83/437, 435.1, 83/441, 441.1, 444, 438, 477.2, 447, 471.3, 409, 468.7, 425; 144/253.1, 253; 269/315

[56] References Cited

U.S. PATENT DOCUMENTS

| | | | |
|---|---|---|---|
| 2,677,400 | 5/1954 | Gaskell | 83/438 |
| 2,799,303 | 7/1957 | Lee | 83/447 |
| 2,890,729 | 6/1959 | Horn | 269/315 |
| 2,985,202 | 5/1961 | Wilson | 143/51 |
| 4,026,173 | 5/1977 | Livick | 83/421 |
| 4,152,961 | 5/1979 | Batson | 83/471.3 |
| 4,164,882 | 8/1979 | Mericle | 83/409 |
| 4,294,151 | 10/1981 | Lemus | 83/477.2 |
| 4,348,925 | 9/1982 | Manweiler | 83/435.1 |
| 4,356,851 | 11/1982 | Glore | 144/253 |
| 4,481,846 | 11/1984 | Goodell | 83/438 |
| 4,485,711 | 12/1984 | Schnell | 83/425 |
| 4,494,430 | 1/1985 | Bautista et al. | 269/315 |
| 4,558,618 | 12/1985 | Bachmann et al. | 83/438 |
| 4,603,612 | 8/1986 | Atkins | 83/425 |
| 5,018,562 | 5/1991 | Adams | 83/437 |
| 5,058,474 | 10/1991 | Herrera | 83/447 |
| 5,134,914 | 8/1992 | Morosini | 83/468.7 |
| 5,161,445 | 11/1992 | Kozyrski et al. | 83/468.7 |
| 5,205,198 | 4/1993 | Foray et al. | 83/435.001 |
| 5,337,641 | 8/1994 | Duginske | 144/253.1 |
| 5,341,711 | 8/1994 | Stay, Jr. et al. | 83/425 |

OTHER PUBLICATIONS

Advertising brochure entitled V E G A, Vega Enterprises, Inc., Sep. 1994.

*Primary Examiner*—Maurina T. Rachuba

*Attorney, Agent, or Firm*—Chernoff, Vilhauer, McClung & Stenzel

[57] ABSTRACT

A safety device for use on powered woodworking tools such as table saws, radial arm saws, and jointer-planers, to push a workpiece through an area of engagement with a rotating blade of such a tool. The safety device includes a guide bar mounted on the power tool in a position where it does not interfere with normal use of the tool, and a workpiece-engaging plate of the safety device is movable along the guide bar by use of a handle located spaced apart from the blade so that the operator of the tool does not have to bring his hands close to the blade while the workpiece-engaging plate moves along a rip fence or guide wall of the tool to advance a workpiece. The workpiece-engaging plate is mounted adjustably on a slide body which can be pivoted about the guide bar as well as being slid along it.

13 Claims, 6 Drawing Sheets

SAFETY DEVICE FOR WOODWORKING TOOLS

BACKGROUND OF THE INVENTION

The present invention relates to a safety device for power-driven woodworking tools, and more particularly to a safety device which is helpful for feeding a workpiece past a rotary blade or cutter of a table saw, a jointer-planer, or a radial arm saw.

A continual safety problem with table saws, radial arm saws and jointer-planers is that there is a distinct risk of a user's fingers or forearm being cut while feeding a long piece of wood past the blades. That is, when sawing a longitudinally oriented narrow strip from a piece of wood, cutting parallel with the grain, or while planing a long board, it is all too easy to cut a finger or worse, especially when feeding the last portion of such a workpiece past the blade. Use of table saws or radial arm saws may be particularly dangerous when they are used to cut very thin slices of wood from a workpiece, so that the usual blade guards cannot be left in place during the sawing operation concerned.

In the past, pusher sticks have been used to push a workpiece over at least the last portion of its path past the blades of such tools. More recently, plastic pusher sticks have been manufactured in a preferred shape for engaging a workpiece, but pusher sticks, whether of wood or of plastic, are somewhat clumsy to use and are themselves often cut by the blade of the tool so that they have to be replaced frequently or are not readily available when they ought to be used.

Other prior art devices have attempted to provide convenient and safer ways to feed workpieces past the blades of such power tools, but without complete success. For example, Schnell U.S. Pat. No. 4,485,711 discloses a device which straddles a rip fence of a circular table saw, with an adjustably located plate holding down and pushing a workpiece along a face of the rip fence.

Livick U.S. Pat. No. 4,026,173 discloses a different device which also straddles and rides along a rip fence, holding down and pushing a workpiece with a pair of long slender members which must be properly adjusted to engage a workpiece and force it past the rotating table saw blade.

Foray et al. U.S. Pat. No. 5,205,198 discloses a clamp arrangement fitted on a guide rail that is mounted on a rip fence. The clamp arrangement carries a workpiece as the entire clamp arrangement is slid along the guide rail. While this apparatus appears to be able to accurately move a workpiece carried in the clamp arrangement, the size of a workpiece which can be accommodated by the arrangement disclosed appears to be limited, and each workpiece must be carefully clamped in place.

In addition, the relevant prior art devices seem likely to obstruct use of a rip fence in some situations and seem to be easily removable from the rip fence and to be set aside or stored away where they will not be readily available when they are most needed.

What is needed, then, is an improved device for enabling the user of a table saw, jointer-planer, or radial arm saw to feed a long workpiece, and particularly the final end of such a workpiece, safely past the rotating blade of such a power tool, and without the need first to find, and perhaps mount, a detachable device such as a workpiece pusher which has been removed from the rip fence or guide wall of the power tool.

SUMMARY OF THE INVENTION

The present invention provides an answer to the aforementioned shortcomings and drawbacks of the prior art in the form of a safety device which may be attached permanently to a rip fence of a circular saw or radial arm saw, or to the guide wall of a jointer-planer, to engage and hold a workpiece while it is pushed toward and past the rotating blade or cutter head of such a power tool. A safety device according to the present invention includes a guide bar mounted above a workpiece-supporting top surface of a power tool table, a slide body mounted on the guide bar, and a workpiece-engaging member fastened to the slide body to hold a workpiece down atop the table and urge it toward and past the blade. The workpiece-engaging member can be a flat plate, and in one embodiment of the invention such a flat plate is attached adjustably to a mating surface of the slide body, which can be positioned coplanar with the surface of a rip fence or guide wall along which a workpiece is moved.

Preferably, the workpiece-engaging member can be rotated about an axis parallel with the guide bar to pass clear of a workpiece or shield as the workpiece-engaging member is drawn back after completion of a cut.

In one embodiment of the invention the guide bar is mounted in a pair of mounting blocks which may be fastened to a rip fence. The slide body can be left on the guide bar and the guide bar can remain in place without interfering with normal use of a rip fence or workpiece guide wall.

In one embodiment of the invention, however, the guide bar can be removed from a pair of mounting blocks supporting it, leaving only the mounting blocks in place.

It is a feature of one embodiment of the invention that it includes a workpiece-engaging member having a hold-down surface which is relatively long and a pushing surface which is relatively short, so that the safety device of the invention can be used to push thin pieces of hard wood past a power tool blade or cutter while holding the wood snugly down atop the table with which the blade or cutter is associated, so as to cut a workpiece accurately and safely.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
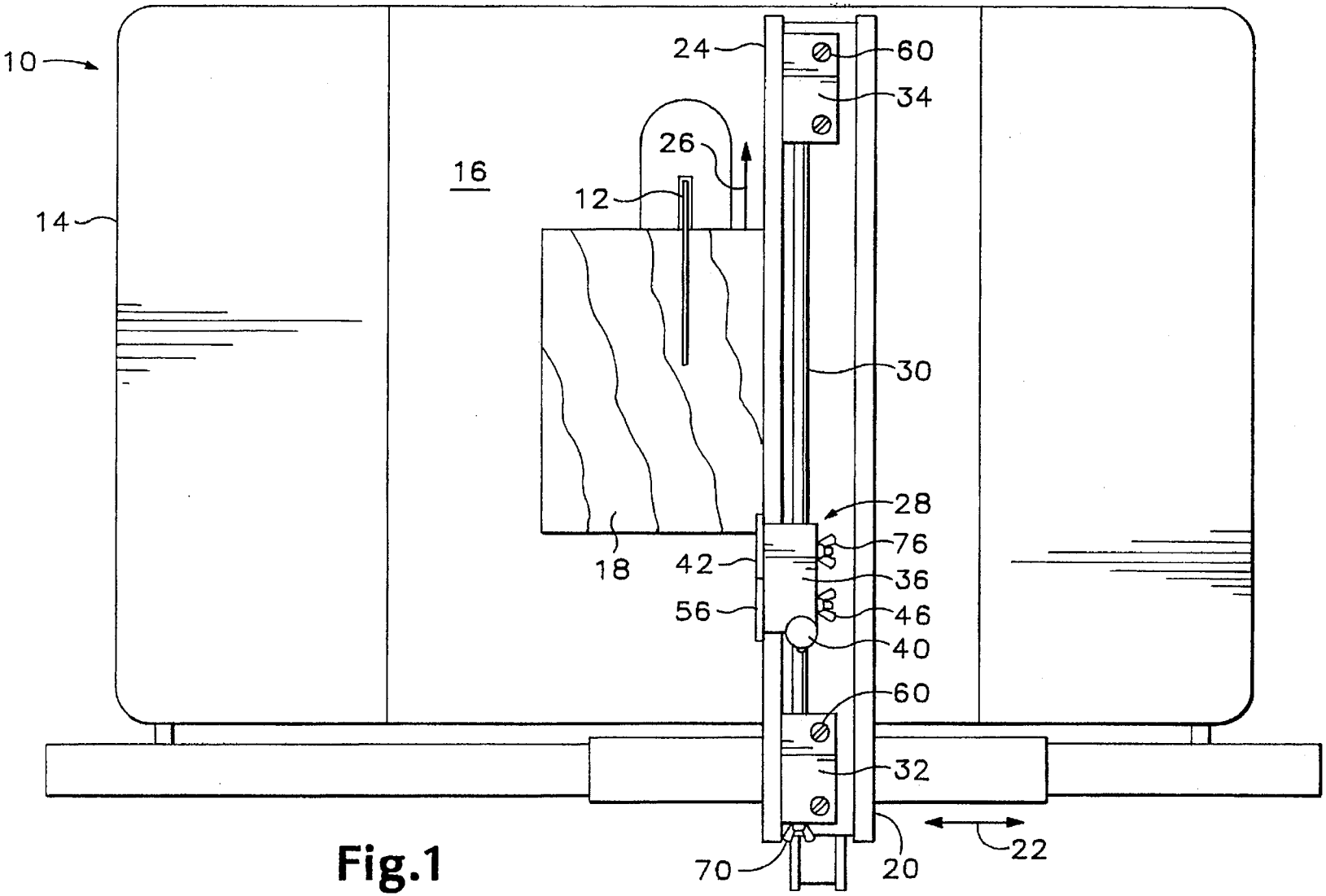
FIG. 1 is a top plan view of a table saw equipped with a safety device according to the present invention.
Figure 2:
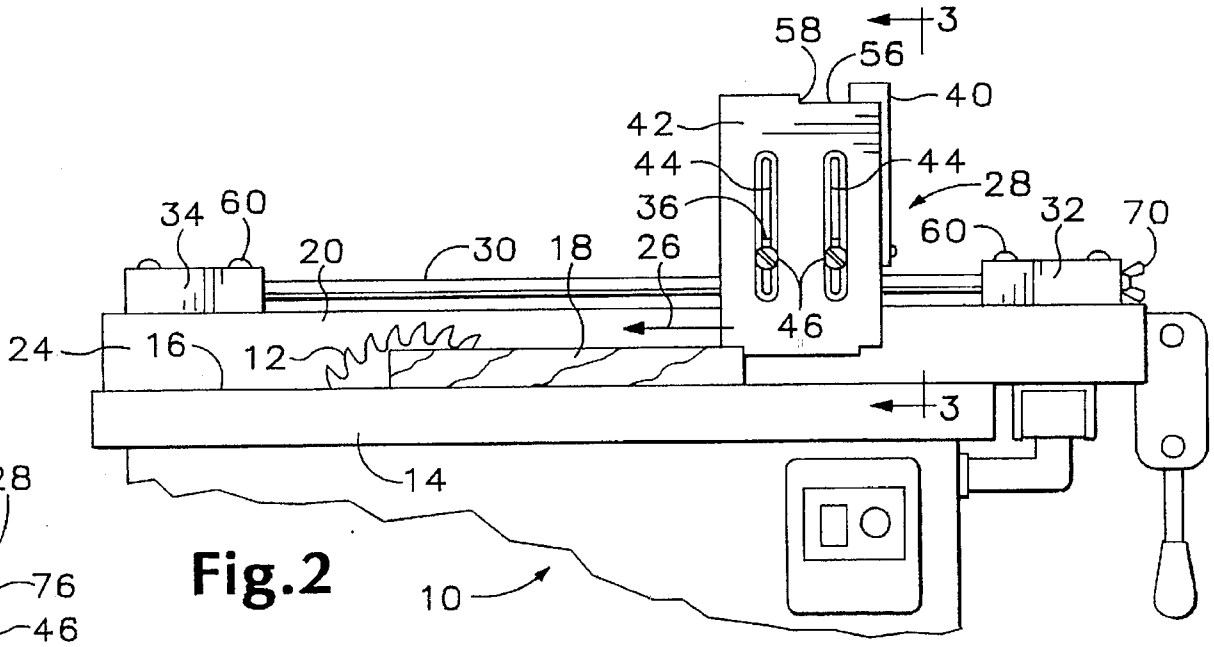
FIG. 2 is a side elevational view of the table saw and safety device shown in FIG. 1.

Referring now to the drawing figures which form a part of the disclosure herein, in FIGS. 1 and 2 a table saw 10 includes a circular saw blade 12, mounted on an arbor and driven by a motor, neither of which is shown. The saw blade 12 extends upward through an opening defined in a table 14 having a top surface 16, to cut a workpiece such as a wooden board 18 resting on the top surface 16.

A rip fence 20 mounted on the table saw 10 is movable sideways in either direction as indicated by the arrow 22, but can be locked in position spaced a desired distance apart from the blade 12. A workpiece-guiding surface 24 of the rip fence 20 extends vertically upward from the top surface 16. The rip fence 20 thus acts as a workpiece guide so that a workpiece such as the board 18 can be moved in the direction indicated by the arrow 26 while resting against the workpiece-guiding surface 24 as the rotating saw blade 12 cuts away a piece of a desired size from the board 18.

So that the operator of the table saw 10 does not need to reach across the circular blade 12 and thereby risk having his hands or arms accidentally cut by the blade 12, a safety device 28 embodying the present invention is mounted atop the rip fence 20. The safety device 28, as shown in additional detail in FIGS. 2–7, includes a guide bar 30, supported by and extending between a front mounting block 32 and a rear mounting block 34, and a slide body in the form of a slide block 36 mounted slidably on the guide bar 30. A longitudinal bore 38 is defined through the slide block 36, and the guide bar 30 is preferably round and fits closely within the longitudinal bore 38. The slide block 36 can thus be slid smoothly along the guide bar 30 and can also be pivoted about the guide bar 30, between the position shown in FIGS. 1, 2, and 3, and the position shown in FIG. 4. A handle 40 is attached fixedly to the slide block 36, to be grasped safely away from the blade 12 to slide the slide block 36 along the guide bar 30, and to pivot the slide block 36 about the guide bar 30.

A workpiece-engaging member, preferably in the form of a flat plate 42, defines a pair of parallel slots 44 which are preferably chamfered to receive the heads of fasteners such as flat headed screws 46 which extend through the slots and through a pair of correspondingly located parallel bores in the slide block 36 to hold the workpiece-engaging member 42 tight against a mating surface 48 of the slide block 36. Preferably the bores for the screws 46 are located high enough in the slide block 36 that they will not be hit by the blade 12 even in its highest position.

The slide block 36, front and rear mounting blocks 32 and 34 and the workpiece-engaging plate 42 may all be of UHMW plastic resin or PTFE or a similar plastic for example. The mounting blocks 32 and 34 are constructed to locate the guide bar 30 with respect to the workpiece-guiding surface 24 of the rip fence 20 so that when the slide block 36 is in the workpiece-advancing position shown in FIGS. 1, 2, 3, and 5, the mating surface 48 is substantially coplanar with the workpiece-guiding surface 24, as may be seen best in FIG. 3.

Figure 3:
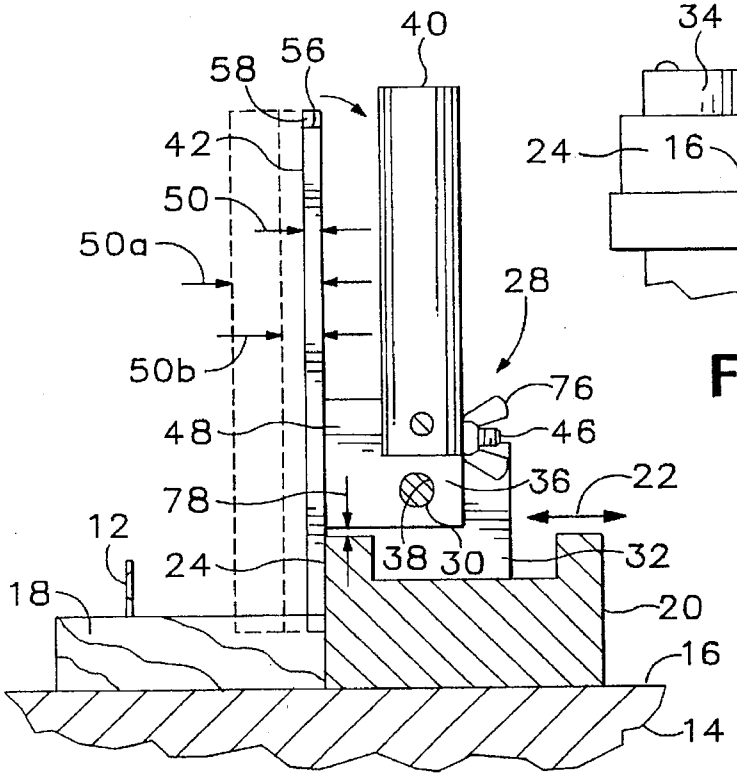
FIG. 3 is a section view of a portion of the table saw shown in FIG. 2, taken along the line 3—3 at an enlarged scale, showing the safety device of the invention in a first workpiece-engaging position.

The workpiece-engaging plate 42 has a thickness 50 of one-eighth inch, for example, but the thickness could be greater, for example, one-half inch, as shown at **50*a*, or one-quarter inch, as shown at 50*b* in FIG. 3**, if the smaller thickness is not required by the need to cut a very narrow piece from a workpiece.

Figures 5, 6, 7:
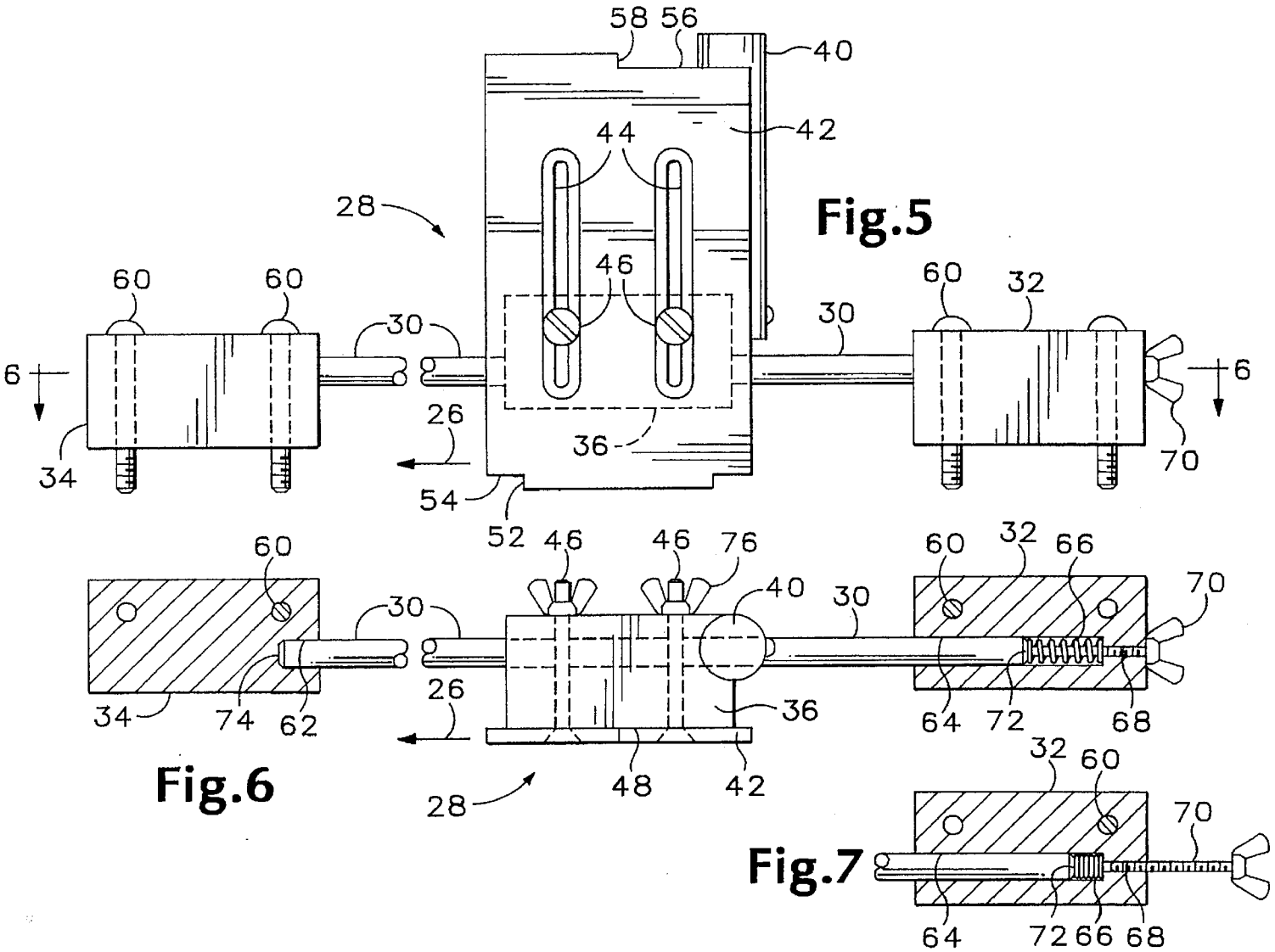
FIG. 5 is a side elevational view, at an enlarged scale, of the safety device shown in FIG. 2.
FIG. 6 is a top plan view of the safety device shown in FIG. 5, with portions of the mounting blocks cut away along the line 6—6.
FIG. 7 is a view similar to a portion of FIG. 6, showing a portion of the safety device with the guide bar prepared for release from the mounting blocks.

The workpiece-engaging plate 42 includes a vertical workpiece-pushing surface 52 and a downwardly-facing workpiece hold-down surface 54, shown in FIG. 5, which together define a small corner cutout in the lower forward corner of the workpiece-engaging plate 42. The workpiece-engaging plate 42 may also be removed from the slide block 30 and replaced in an inverted position to bring a larger hold-down surface 56 and a workpiece pushing surface 58 similar to the pushing surface 52 into position for engaging a workpiece such as a thin piece of hard wood (not shown), for which an ability to provide more downward pressure might be desirable to provide additional security in holding the workpiece against the top surface 16 of the table 14.

The front and rear mounting blocks 32 and 34 are attached to the top of the rip fence 20 by respective bolts 60, and each block should have its bottom shaped to mate against the top of the rip fence 20. Alternatively, an appropriate adaptor (not shown) might be used between the block and the rip fence. The rear mounting block 34 defines a shallow bore 62 which receives a rear end 74 of the guide bar 30 in a snug sliding relationship. A bore 64 defined in the front mounting block 32 is substantially deeper. Within the bore 64 a helical compression spring 66 is located, fitting loosely enough within the bore 64 to move freely when compressed or relaxed. A threaded smaller bore 68 is defined through the front end of the front mounting block 32 and extends coaxially into the larger bore 64. The threads of the bore 68, if the front mounting block 32 is of a plastic resin, may be optionally provided within a double threaded metal sleeve (not shown) mounted in the front mounting block 32.

A fixing screw 70 is engaged with the threads in the smaller bore 68 and extends through the bore 68 into the bore 64. The fixing screw 70 is small enough in diameter to fit within the helix of the spring 66 and ordinarily extends through the entire length of the spring 66 and pushes against the front end 72 of the guide bar 30, as shown in FIG. 6. The front and rear mounting blocks 32 and 34 are located so that this position of the fixing screw prevents the rear end 74 of the guide bar 30 from being withdrawn from the bore 62. If it is desired to remove the guide bar 30 from its normal position extending between the mounting blocks 32 and 34, the fixing screw 70 can be unscrewed to the position shown in FIG. 7, giving room for the front end 72 of the guide bar 30 to be pushed further into the bore 64, compressing the spring 66 within the bore 64, while the rear end 74 of the guide bar 30 is removed from its normal position in the bore 62. Until the spring 66 is thus compressed it holds the guide bar 30 so that its rear end 74 remains held in the bore 62.

In using the safety device 28 of the present invention in connection with the table saw 10, the position of the workpiece-engaging plate 42 should be adjusted, by loosening the wing nuts 76 on the screws 46 sufficiently for their heads to move along the slots 44 to allow the plate 42 to be raised or lowered as necessary to bring the hold-down surface 54 snugly into contact with the top of a horizontally-oriented workpiece such as the board 18. This should be done with the slide block 36 in the position of rotation about the guide bar 30 shown in FIG. 3, with the mating surface 48 aligned parallel with the workpiece-guiding surface 24. The wing nuts 76 are then tightened to hold the workpiece-engaging plate 42 against the mating surface 48. With the hold-down surface 54 pressing down on the board 18, by grasping the handle 40 to keep the slide block 36 in the appropriate position, the slide block 36 and the associated workpiece-engaging plate 42 are moved in the direction of the arrow 26 as the pushing surface 52 moves the board 18 forward along the guiding surface 24 of the rip fence 20 at the appropriate rate to saw the board 18.

Figure 4:
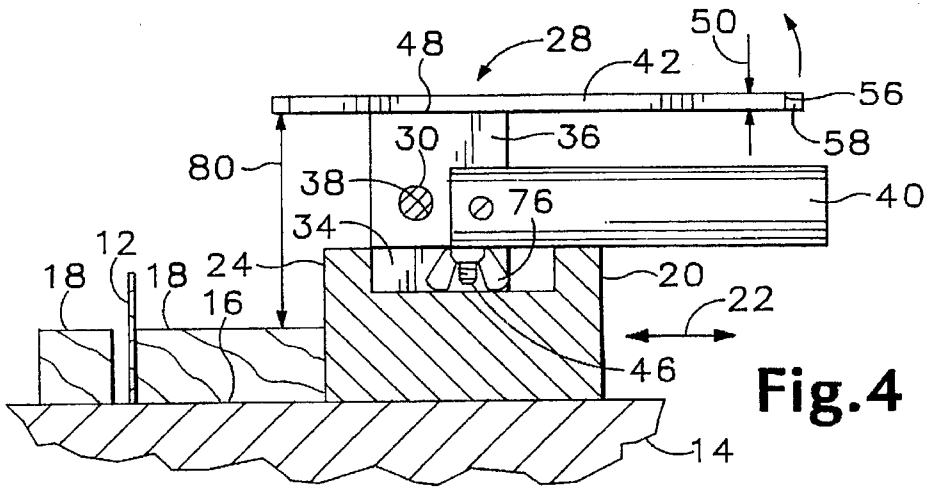
FIG. 4 is a view similar to that of FIG. 3, but with the safety device of the invention in a second position.

Once the entire workpiece-engaging plate 42 has passed beyond the saw blade 12, the handle 40 and the slide block 36 can be pivoted clockwise as viewed in FIG. 3, rotating the workpiece-engaging member 42 to a retraction position such as the position shown in FIG. 4, so that it can be retracted without encountering the saw blade 12, to a position behind the next successive workpiece to be sawed.

In some situations, as where the blade 12 is raised relatively high above the top surface 16 of the table 14, the safety device 28 can also be used to advance a tall workpiece, with the workpiece-engaging member 42 in a laterally-extending horizontal position as shown in FIG. 4.

The mounting blocks 32 and 34 are preferably of such a size and are located on the top of the rip fence 20 in such a location that when the slide block 36 is in the first workpiece-advancing position, as shown in FIG. 3, there is a small clearance 78 beneath the slide block 36 which permits downward pressure to be exerted, accommodated if necessary by a slight resilient downward flexing of the guide bar 30 as the slide block 36 is moved along it, to allow desired downward pressure to be exerted on the board 18 as it is being cut by the saw blade 12.

The location of the guide bar 30 is preferably chosen to be far enough laterally offset from the workpiece guiding surface 24 so that a clearance 80, between the workpiece-engaging member 42, in its horizontal position as shown in FIG. 4, and the top surface 16, is greater than the maximum height of the blade 12 adjusted to its highest raised position. The workpiece-engaging plate 42 thus will pass clear of and above the saw blade 12 when the rip fence 20 is located close to the saw blade 12.

Figure 8:
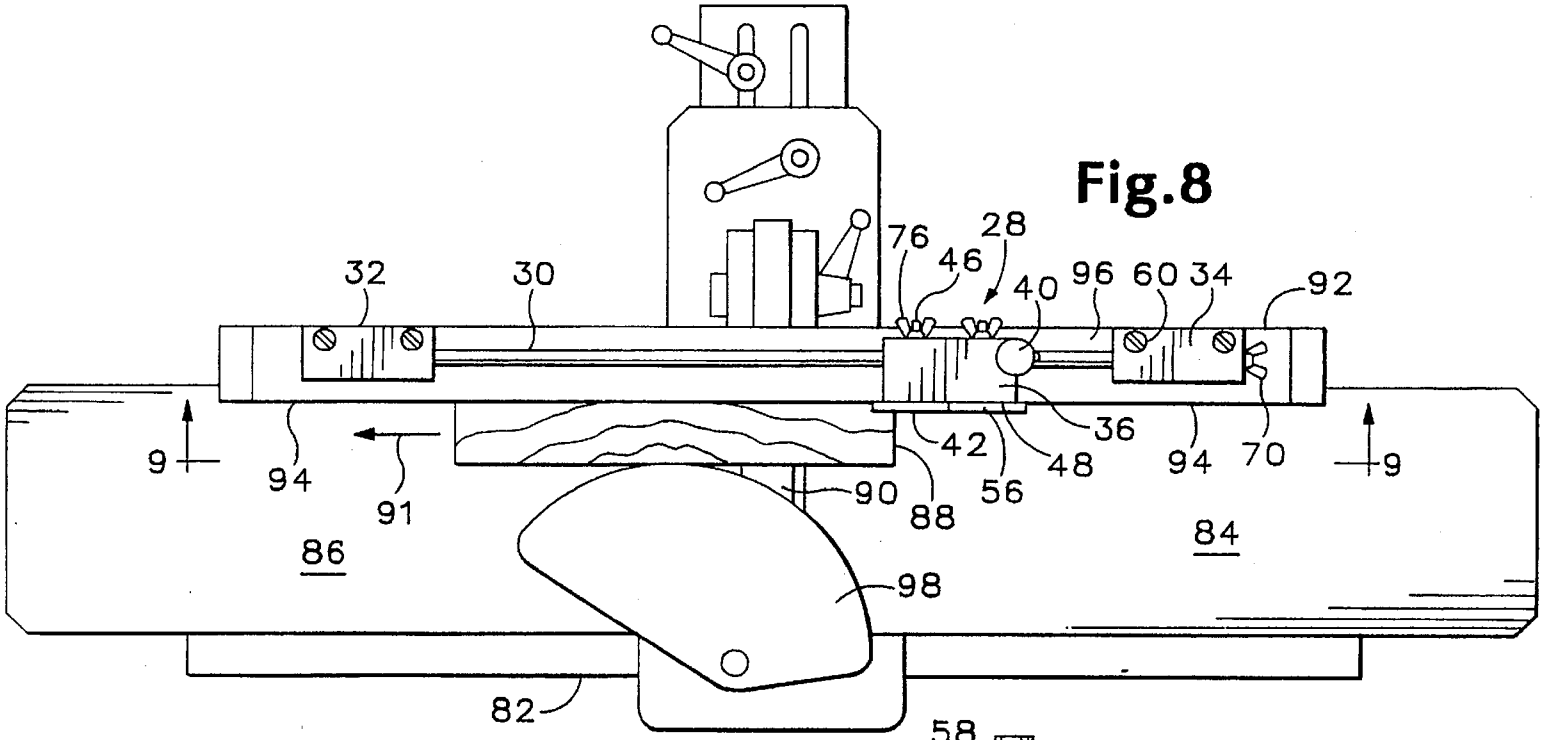
FIG. 8 is a top plan view of a jointer-planer with a safety device according to the present invention mounted thereon.
Figure 9:
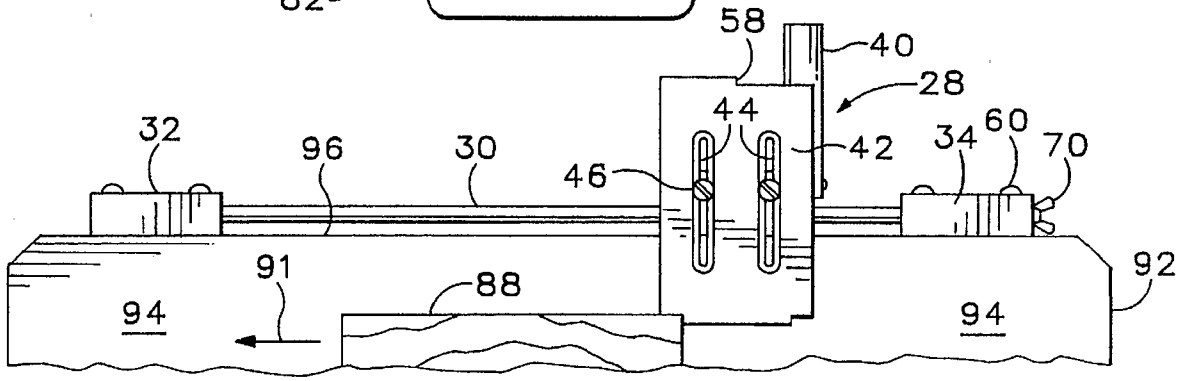
FIG. 9 is a side elevational view of a portion of the jointer-planer and safety device shown in FIG. 8, taken along line 9—9.

The safety device 28 according to the present invention is also useful on a jointer-planer 82, as shown in FIGS. 8 and 9. The jointer-planer has a two-section table having a top surface 84 which is adjustable in height with respect to a second top surface 86, the difference in heights of the two top surfaces establishing the depth of a cut taken as a workpiece such as a board 88 is moved past the rotating cutter blades 90 in the direction of the arrow 91. A guide wall 92 of the jointer-planer 82 has a workpiece-guiding surface 94 and a top face 96.

The safety device 28 according to the present invention is utilized with the jointer-planer 82 by mounting the front and rear mounting blocks 32 and 34 on the top face 96 of the guide wall 92. Since the cutter blade 90 does not extend above the top surface 86, the height of the guide bar 30 above the top face 96 is not critical, although it is necessary that there be enough clearance beneath the guide bar 30 for the slide block 36 to be rotated far enough toward a retraction position such as that shown in FIG. 4 so that the workpiece-engaging member 42 can be retracted above the safety shield 98 and a successive workpiece. Thus, it may not be necessary to provide clearance to permit rotation of the slide block 36 fully through 90° to the position shown in FIG. 4.

The width of the slide block 36 and the lateral position of the guide bar 30, however, should be chosen so that the workpiece-engaging member 42 is positioned parallel with and substantially in contact with the workpiece-guiding surface 94, and so that the mating surface 48 is substantially coplanar with the workpiece-guiding surface 94 when the slide block 36 is in the workpiece-advancing position as shown in FIGS. 8 and 9.

Figure 10:
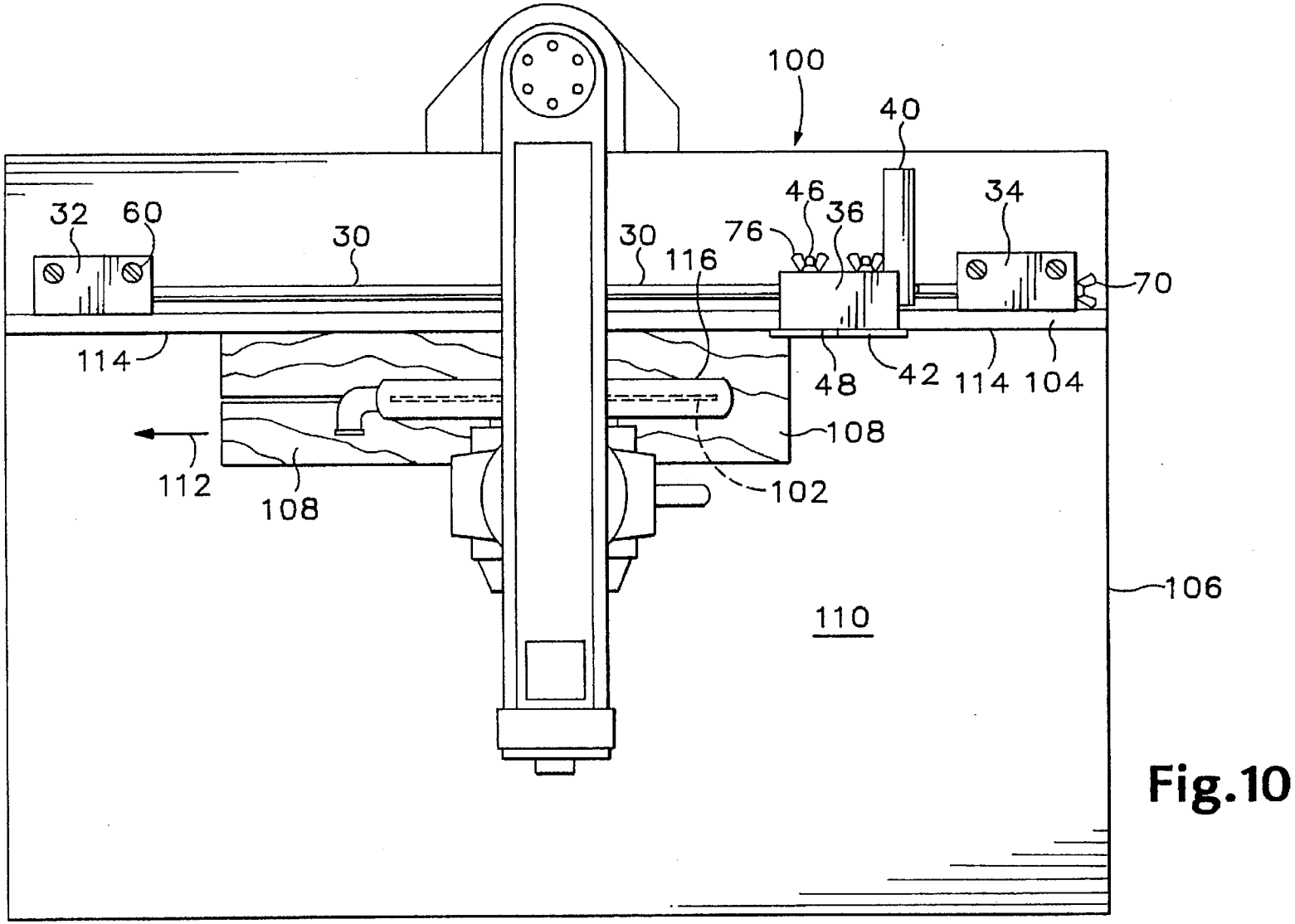
FIG. 10 is a top plan view of a radial arm saw equipped with a safety device according to the present invention.
Figure 11:
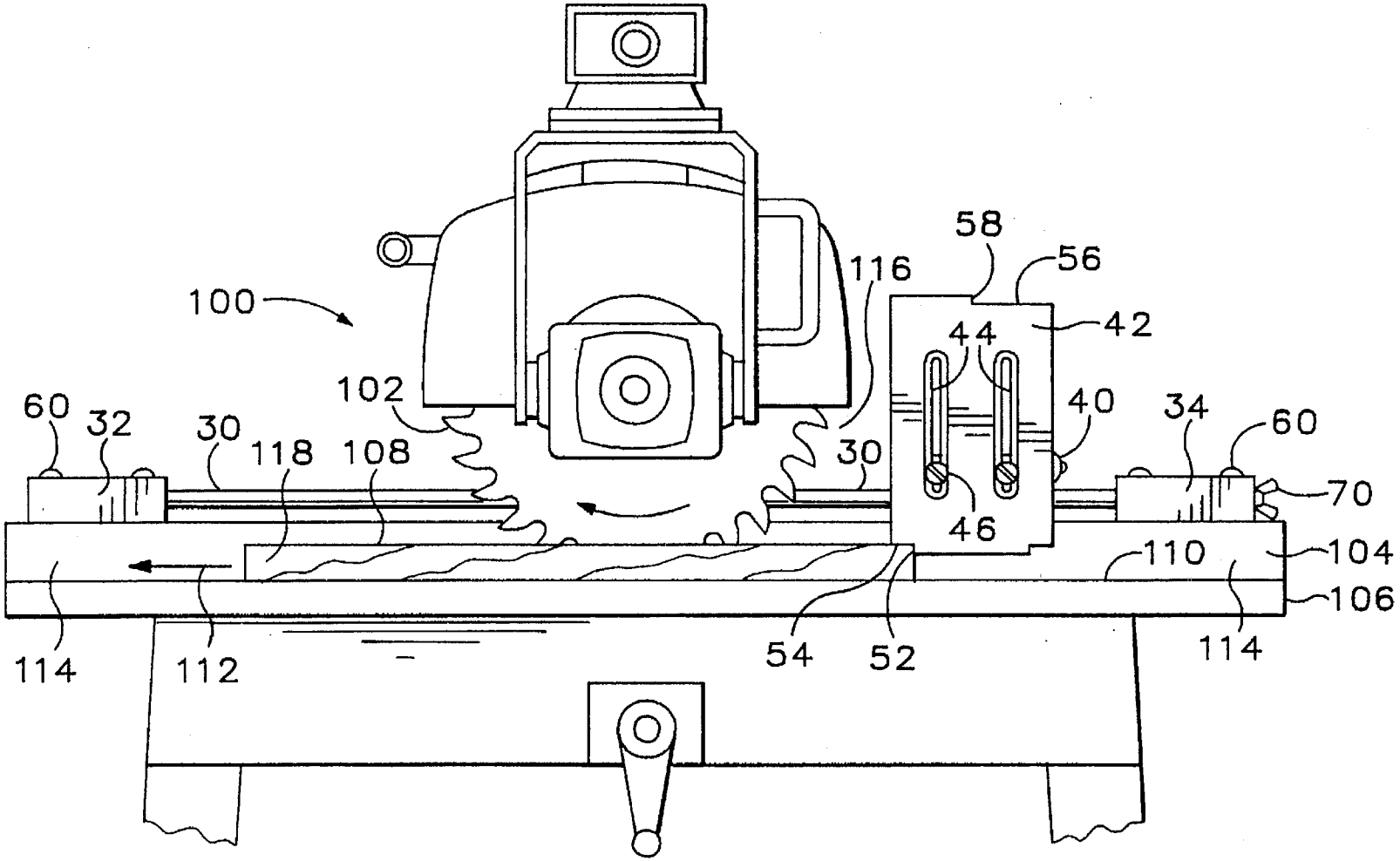
FIG. 11 is an elevational view of the radial arm saw and the safety device shown in FIG. 10.

The safety device 28 of the present invention is also useful with a radial arm saw 100, as shown in FIGS. 10 and 11. For rip sawing, the radial arm saw is used with its blade motor held in a position in which the circular blade 102 rotates in a vertical plane parallel with a rip fence 104 located atop the table 106, to saw a workpiece such as the board 108 as it is pushed along the top surface 110 of the table 106 in the direction indicated by the arrow 112. The safety device 28 is attached to the table 106 behind the rip fence 104, using front and rear mounting blocks 32 and 34 of an appropriate size and located appropriately to have the guide bar 30 parallel with the top surface 110 and the workpiece-guiding surface 114 of the rip fence 104. The dimensions of the slide block 36 and the distance between the guide bar 30 and the workpiece-guiding surface 114 are also coordinated as will be understood with reference to the description of the safety device 28 in use on the table saw 10, to have the workpiece-engaging member 42 slide along the workpiece-guiding surface 114 with the mating surface 48 of the slide block 36 substantially in the plane of the workpiece-guiding surface 114.

In using the safety device 28 on a radial arm saw such as the saw 100, however, it is preferable not to rotate the slide block 36 about the guide bar 30 until the workpiece-engaging member 42 has been retracted clear of the circular blade 102 on its infeed side 116, when it may be desired to rotate the slide block 36 to provide ample clearance beneath the workpiece-engaging member 42 while a leading end 118 of the board 108 is fed along the workpiece-guiding surface 114. For that reason it is preferred to fasten the handle 40 to the slide block 36 to extend horizontally when the workpiece-engaging member 42 is in its upright position alongside the workpiece-guiding surface 114 of the fence 104 as shown in FIGS. 10 and 11.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A safety device for use in advancing a workpiece into cutting engagement with a blade of a power tool including a table having a top surface and a workpiece guide including a workpiece-guiding surface extending above said top surface, the safety device comprising:

(a) a guide bar;

(b) a slide body slidably mounted on said guide bar, said slide body being rotatable about an axis parallel with said guide bar, between a workpiece-advancing position and a retraction position, said slide body including a mating surface extending parallel with said guide bar;

(c) a workpiece-engaging member fastened to said slide body in contact with said mating surface; and (d) a pair of mounting devices engaging said guide bar and supporting said guide bar in a predetermined position.

2. The safety device of claim 1 wherein said workpiece-engaging member includes a workpiece hold-down surface that faces downward toward said top surface when said slide body is in said workpiece-advancing position.

3. The safety device of claim 1 including a handle attached to said slide body and capable of moving said slide body along said guide bar.

4. The safety device of claim 1 wherein said workpiece-engaging member is a flat plate defining at least one adjustment slot and attached to said slide body by a fastener engaging said adjustment slot.

5. The safety device of claim 4 wherein a part of said workpiece-engaging member extends closely along and parallel with said workpiece-guiding surface when said slide body is in said workpiece-advancing position.

6. The safety device of claim 1 wherein said guide bar is round and said slide body defines a longitudinal bore therethrough and wherein said guide bar is engaged in said bore.

7. In combination with a power tool including a table having a top surface and a workpiece guide extending above said top surface, said workpiece guide including a workpiece-guiding surface, a safety device for use in advancing a workpiece into cutting engagement with a blade of said power tool, the safety device comprising:

(a) a guide bar having a longitudinal axis;

(b) a slide body mounted on said guide bar and slidable therealong, said slide body being rotatable through an angle about said longitudinal axis of said guide bar, between a workpiece-advancing position and a retraction position, said slide body including a mating surface extending parallel with said guide bar;

(c) a workpiece-engaging member fastened to said slide body in contact with said mating surface; and (d) a pair of mounting devices engaging said guide bar and supporting said guide bar in a predetermined position with respect to said workpiece guide.

8. The safety device of claim 7 wherein said guide bar is located above said top surface a distance great enough for said workpiece-engaging member to pass above said blade when said guide body is rotated to said retraction position.

9. The safety device of claim 7 wherein said power tool is a table saw having a circular saw blade, land wherein said workpiece guide is a rip fence associated with said table saw and said mounting devices are located atop said rip fence.

10. The safety device of claim 9 wherein said guide bar is so located that said workpiece-engaging member is in position to slide along said rip fence in contact with said workpiece-guiding surface of said rip fence when said slide body is in said workpiece-advancing position.

11. The safety device of claim 7 wherein said slide body defines a mating surface that is substantially coplanar with said workpiece-guiding surface of said power tool when said workpiece-engaging member is in said workpiece-advancing position.

12. The safety device claim 7 wherein said power tool is a jointer-planer and said mounting devices are located atop a guide wall thereof that includes said workpiece-guiding surface.

13. The safety device of claim 7 wherein said power tool is a radial arm saw and said mounting devices are located atop a rip fence thereof including said workpiece-guiding surface.

* * * * *

UNITED STATES PATENT AND TRADEMARK OFFICE
CERTIFICATE OF CORRECTION

PATENT NO : 5,662,019

DATED : September 2, 1997

INVENTOR(S) : Denman, Paul M.

It is certified that error appears in the above-identified patent and that said Letters Patent is hereby corrected as shown below:

| | |
|---|---|
| Col. 8, Line 6 | change "land" to read --and--. |
| Col. 8, Line 19 | insert --of-- between "device" and "claim 7" |

Signed and Sealed this

Fourteenth Day of March, 2000

*Attest:*

*Attesting Officer*

Q. TODD DICKINSON

*Commissioner of Patents and Trademarks*